US005539379A

United States Patent [19]

MacPherson

[11] Patent Number: 5,539,379

[45] Date of Patent: Jul. 23, 1996

[54] SECURITY ENCLOSURE MANUFACTURE

[75] Inventor: Hugh MacPherson, Milnathort, United Kingdom

[73] Assignee: W. L. Gore & Associates (UK) Ltd., London, United Kingdom

[21] Appl. No.: 397,159

[22] PCT Filed: Sep. 9, 1993

[86] PCT No.: PCT/GB93/01901

§ 371 Date: Mar. 3, 1995

§ 102(e) Date: Mar. 3, 1995

[87] PCT Pub. No.: WO94/07221

PCT Pub. Date: Mar. 31, 1995

[30] Foreign Application Priority Data

Sep. 22, 1992 [GB] United Kingdom ..... 9219996

[51] Int. Cl.[6] ..... G08B 13/02

[52] U.S. Cl. ..... 340/550; 109/42; 206/807

[58] Field of Search ..... 340/550; 109/42, 109/41, 38; 206/807

[56] References Cited

U.S. PATENT DOCUMENTS

| | | | |
|---|---|---|---|
| 3,763,795 | 10/1973 | Weltz, Jr. | 340/550 |
| 4,785,743 | 11/1988 | Dalphin | 109/40 |
| 4,972,175 | 11/1990 | MacPherson | 340/550 |
| 5,049,854 | 9/1991 | Wolf | 340/550 |
| 5,224,430 | 7/1993 | MacPherson | 109/42 |
| 5,285,734 | 2/1994 | MacPherson | 340/550 |
| 5,289,785 | 3/1994 | MacPherson et al. | 109/42 |

FOREIGN PATENT DOCUMENTS

| | | |
|---|---|---|
| 598272 | 1/1988 | Australia . |
| 277679 | 8/1988 | European Pat. Off. . |
| 347209 | 12/1989 | European Pat. Off. . |
| 459838 | 6/1991 | European Pat. Off. . |
| 1375926 | 12/1974 | United Kingdom . |
| 2220513 | 1/1990 | United Kingdom . |
| 2256956 | 12/1992 | United Kingdom . |
| 2256957 | 12/1992 | United Kingdom . |
| 2256958 | 12/1992 | United Kingdom . |
| 2258075 | 1/1993 | United Kingdom . |
| WO8706749 | 11/1987 | WIPO . |

*Primary Examiner*—Glen Swann
*Attorney, Agent, or Firm*—Gary A. Samuels

[57] ABSTRACT

A security enclosure (20) includes an inner enclosure defined by a first electrically insulating sheet (60) carrying a layer (56) of electrically responsive material on an outer side, the sheet (60) being folded and having edges (100) in overlapping relation and adhered to one another to define the inner enclosure. A detector (80) is provided for detecting separation of the electrically responsive material (56) from the sheet (60) and is located inside the inner enclosure. An outer enclosure is defined by a second electrically insulating sheet (44) wrapped about and adhered to the inner enclosure and also having edges in overlapping relation.

24 Claims, 8 Drawing Sheets

SECURITY ENCLOSURE MANUFACTURE

FIELD OF THE INVENTION

This invention relates to the manufacture of security enclosures, and more particularly, but not exclusively, to the manufacture of security enclosures for giving warning, or destroying or erasing information, if interference is made with the enclosure with the aim of gaining access to an object within the enclosure. The invention has particular application to security enclosures having walls formed of flexible laminates which have been folded to form the enclosures.

BACKGROUND OF THE INVENTION

It is known to provide security enclosures with walls or sheets incorporating coils, meshes or grids of electrically responsive material and to monitor certain electrical characteristics of the material to provide an indication when the sheet containing the material has been pierced or an attempt has been made to open the enclosure through other means. Detection of such an attempt may activate an alarm, destroy the material or object within the enclosure, or erase information if the object within the enclosure, for example, contains sensitive magnetically recorded information. Examples of such enclosures are disclosed in PCT International Application Publication No. WO87/06749 to Wolf, U.K. Patent No. 1,375,926 to GAO Gesellschaft Fur Automation und Organisation mbH, U.S. Pat. No. 4,785,743 to Dalphin and European Patent Publication No. 277,679 to Seculock BV. However, the present invention is more closely related to security enclosures of the form disclosed in U.K. Patent Application No. GB 2220513A, to W. L. Gore and Associates, Inc. The disclosed security enclosures are formed from layers of flexible material including a matrix of diagonally extending semi-conductive lines printed onto a rectangular thin insulating film. The matrix of lines forms a continuous conductor which is broken if attempts are made to penetrate the film. The circuit is monitored by opening the conductor at one point and measuring the change of resistance between the two ends of the circuit.

The Gore security enclosure also includes a further protective laminate comprising two flexible layers of semi-conductive fibrous material separated by a layer of insulating material. The lengths of the fibres of the fibrous material are greater than the thickness of the layer of insulating material so that piercing the enclosure forces fibres from one fibrous layer to penetrate the insulating layer and contact the other fibrous layer to produce a detectable change in an electrical characteristic of the layers.

Further, the Gore application discloses enclosures in the form of shallow, rectangular envelopes formed simply by folding the rectangular laminate about a single axis and then securing the edges of the laminate to one another to form the envelope.

Security enclosures in the form of wedge-shaped, cuboid and cube form are disclosed in U.K. Patent Application GB 2258075A (W. L. Gore & Associates (UK) Ltd). in which a laminate is folded about a plurality of fold lines to form the enclosures. This facilitates formation of enclosures for containing objects that are other than thin and flat.

Further improved security enclosures are also described in the W. L. Gore & Associates (UK) Ltd. U.K. Patent Applications GB 2256956A, GB 2256957A and GB 2256958A, each of which describes features for increasing the difficulty of gaining unauthorised access to the enclosure. In GB 2256956A two layers of semi-conductive fibrous material are separated by a layer of auto-pyrotechnic insulating material. In addition to detecting physical penetration, as discussed above with reference to GB 2220513A, if a laser or other elevated temperature cutting means penetrates the layers the laser ignites the auto-pyrotechnic material and the subsequent decomposition of the layer will result in the fibrous layers coming into contact with one another.

In GB 2256957A, a matrix of semi-conductive lines is printed on a thin insulating film, the matrix of lines forming a plurality of conductors which are individually monitored. The lines extend over both sides of the insulating film and are joined at the edges of the film to define the conductors, each of which comprises a large number of line segments. The configuration of the connections between the lines may be varied such that the conductors may be formed of different configurations of lines. Thus, it would be difficult for an intruder to predict the combination of line segments which defined a particular conductor. In the preferred embodiment each conductor is of the same electrical length such that the configuration of the connections between the conductors and a monitoring circuit may also be varied, further increasing the difficulty of gaining access to the enclosure by isolating individual conductors from the monitoring circuit.

In GB 2256958A a low tensile strength layer is provided between a monitored conductor and a first insulating film, and a second insulating film is adhered over the conductor. An attempt to remove the second insulating film to gain access to the conductor results in break-up of the low tensile strength layer and detectable damage of the conductor.

The preferred embodiment described in GB 2256958A also includes semi-conductive fibrous layers separated by an insulating layer as described in GB 2220513A. However, in addition, two layers of semi-conductive low melt material are provided, one on each side of the insulating layer. If an attempt is made to penetrate the laminate using a laser the low melt material will melt and flow through any breaks in the insulating layer to form a detectable electrical connection between the semi-conductive fibrous layers. A similar arrangement is also described in European Patent Application No. 0459838.

When forming an enclosure from such laminates it is of course necessary to overlap edges of the laminates to define the enclosure. To ensure the security of the enclosure the overlapping edges must be carefully formed such that separation of the edges, held together by an adhesive, does not permit unauthorised entry to the enclosure. An example of an overlapping edge configuration is disclosed in GB 2256958A (FIG. 3) in which the layers of the laminate are feathered and an additional layer of low tensile strength material is provided below conductive lines provided at one of the edges. While providing a secure join, the necessity to feather the edges of the various layers of the laminate and provide additional layers of material at the edges of the laminate adds to the complexity and expense of forming the enclosure.

Further, when forming box-like security enclosures, such as described in GB 2258075A, it is desirable to fold the laminate on itself to allow the creation of corners between walls of the enclosure. It would of course be possible to form the laminates such that such folding was not required, for example by utilising a cruciform-shaped laminate to form a cuboid enclosure, though this would increase the difficulty of forming the layers on the laminate, particularly the lines which form the conductors, due to the more complex shapes which would be required, and would produce less secure areas in the enclosure between the edges of the laminate which would be brought together to define the corners of the enclosure. Thus, folding the laminate on itself is considered a desirable step, though there are still potential weak spots at such folds, for example where electrically insulating layers are brought together, as the layers could possibly be separated without damaging the detecting layers which lie below the insulation. Where two electrically responsive layers of lines would otherwise be brought together by folding, one half of each portion may be provided without such lines as proposed in GB 2258075A, though this increases the difficulty of forming conductors formed of such lines due to the more complex shapes which are required.

It is among the objects of the present invention to provide a method of forming a security enclosure defined by a laminate with overlapping edges in which such edges are secure and may be formed relatively easily.

SUMMARY OF THE INVENTION

According to the present invention there is provided a method of forming a security enclosure comprising the steps:

providing a first electrically insulating sheet carrying a layer of electrically responsive material on one side;

providing detection means for detecting separation of the electrically responsive material from the sheet;

connecting said detection means to the layer;

folding said first electrically insulating sheet to define an inner enclosure with said electrically responsive layer extending over an external surface thereof and said detection means located therewithin;

providing a second electrically insulating sheet;

providing adhesive on at least one of said external surface of the inner enclosure and said second electrically insulating sheet; and wrapping said second electrically insulating sheet about said inner enclosure to encapsulate said inner enclosure.

To gain entry to a security enclosure formed by this method, other than by cutting through the sheets and the electrically responsive layer, it would be necessary to separate the second electrically insulating sheet from the first electrically insulating sheet. If an attempt was made to peel back the second sheet separation would result in break up of the electrically responsive layer as the sheets were pulled apart. Such damage would be detected by the detection means.

Preferably, a low tensile strength material having lower cohesion than adhesion is located between the first electrically insulating sheet and the electrically responsive material.

The layer of electrically responsive material may be continuous or discontinuous. Preferably, the electrically responsive material is provided in the form of one or more lines.

Preferably also, adhesive material is provided at selected edge portions of said first electrically insulating sheet and on folding said sheet to define the inner enclosure said selected edge portions are placed in overlapping relation.

Preferably also, said second electrically insulating sheet is wrapped about said inner enclosure with edge portions of said second electrically insulating sheet in overlapping relation.

For use in forming a box-like enclosure, the method of the present invention preferably comprises the further steps of:

providing the first electrically insulating sheet with electrically responsive line carrying major wall forming portions and intermediate wall forming portions located between the major wall forming portions;

folding said intermediate wall forming portions to permit said major wall forming portions to define corners of a box-like enclosure including folding of selected intermediate wall forming portions to produce electrically responsive line to electrically responsive line interfaces;

providing first wings of electrically insulating sheet extending beyond an area of said first electrically insulating sheet carrying said electrically responsive line; and locating said first wings between said folded selected intermediate wall forming portions to provide electrically responsive line to electrically insulating material interfaces therebetween.

The provision of the first wings prevents electrical contact between the electrically responsive line carrying intermediate wall forming portions. It would be possible to produce a somewhat similar effect by providing areas of the intermediate wall forming portions without the electrically responsive line though this would greatly increase the complexity and difficulty in forming such a line, and which difficulty would be greatly increased where it was desired to provide a plurality of lines to form a plurality of monitored conductors and it was desired that the conductors of would have the same electrical characteristics or length.

It is also preferred that the method includes the further steps: of folding further selected intermediate wall portions to produce electrically insulating material to insulating material interfaces; providing second wings of electrically insulating sheet carrying portions of said electrically responsive line; and locating said second wings between said folded further selected intermediate wall portions to provide electrically responsive line to electrically insulating material interfaces therebetween.

This arrangement allows the enclosure to be formed without the occurrence of insulating material to insulating material interfaces at sensitive areas of the enclosure. Such interfaces could facilitate unauthorised entry to the enclosure as the layers of insulating material could be separated without causing damage to the electrically responsive line carried on the other sides of the sheet. In practice, it is desirable to minimise the number of such second wings as their presence increases the complexity of formation of the electrically responsive line on the insulating sheet.

Preferably also, the method includes the further steps of:

providing said first electrically insulating sheet with lines of electrically responsive material on each side, the lines on one side extending obliquely relative to the lines on the other side and the lines being interconnected at edge portions of the sheet to form a plurality of conductors so dividing the sheet into a number of relatively small areas that attempted penetration of the sheet damages one or more lines, one edge portion of the sheet including a plurality of line switch means;

selectively configuring the switch means to connect each one of the lines on one side of the sheet with a selected one of a plurality of lines on the other side of the sheet; and connecting ends of the conductors to the detecting means for detecting damage to the lines.

The provision of the line switch means permits the configuration of the conductors to be varied such that a detailed examination of one security enclosure would not enable a potential intruder to predict the paths of the conductors of another, similar, security enclosure.

Preferably also, the overlapping edge portions of the second electrically insulating sheet are formed on the inner enclosure spaced from the overlapping edge portions of the first electrically insulating sheet. This arrangement increases the difficulty of gaining unauthorised entry to the enclosure by separation of the sheets. With this arrangement it would be necessary to first separate the overlapping edges of the second sheet, then separate the second sheet from the first sheet until the overlapping edges of the first sheet were exposed, and then separate the overlapping edges of the first sheet before entry to the enclosure was possible. The areas of separation required to achieve this would be relatively large thus increasing the likelihood of detection of the attempt to gain entry by the separation detection means.

Preferably also, the overlapping edge portions of the first electrically insulating sheet and the overlapping edge portions of the second electrically insulating sheet are formed of opposite hand. With this arrangement, the second sheet must be separated from the first sheet to the most distant edge of the inner overlap before an attempt is made to separate the overlapping edges of the first sheet, thus increasing the degree of the separation of the layers required to gain access to the inner overlap.

In accordance with a further aspect of the present invention there is provided a security enclosure comprising:

an inner enclosure defined by a first electrically insulating sheet carrying a layer of electrically responsive material on an outer side thereof, the sheet being folded and having edges in overlapping relation and adhered to one another to define the inner enclosure;

detecting means for detecting separation of the electrically responsive material from the sheet and said means being located inside said inner enclosure; and an outer enclosure defined by a second electrically insulating sheet wrapped about and adhered to said inner enclosure and having edges in overlapping relation.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
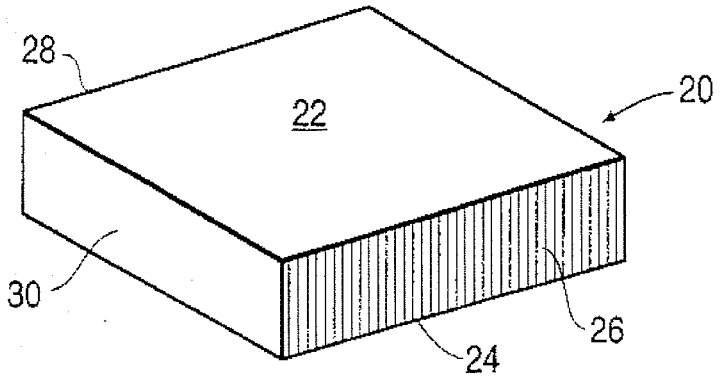
FIG. 1 is a perspective view of a security enclosure in accordance with a preferred embodiment of the present invention.
Figure 2:
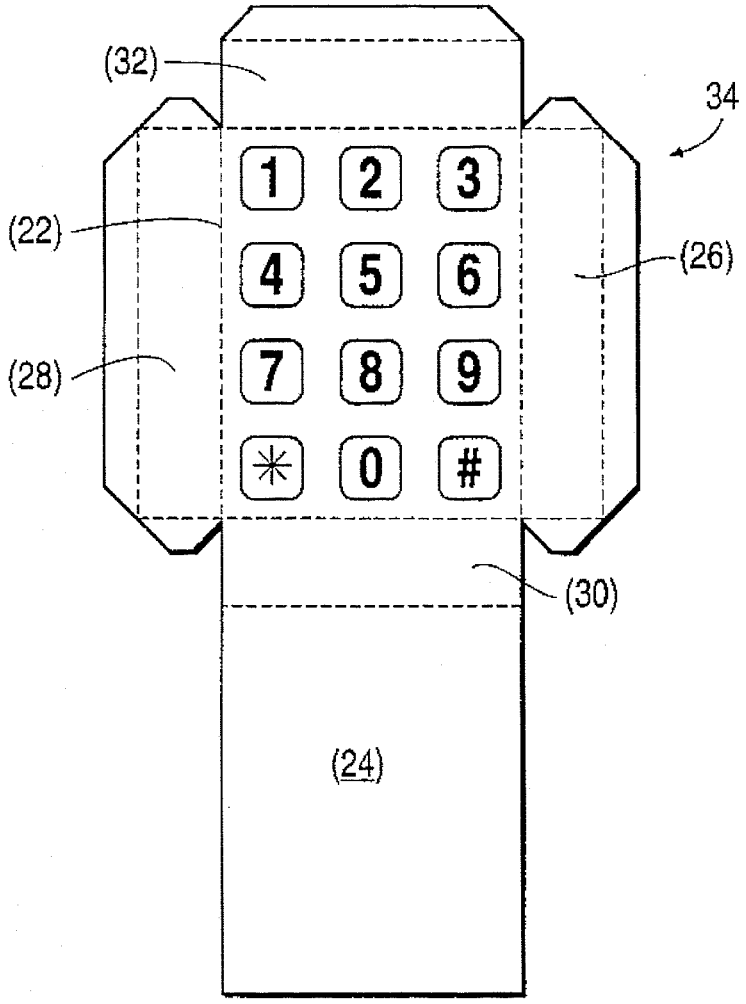
FIG. 2 is a plan view of an outer protection layer of the enclosure of FIG. 1.

Reference is first made to FIGS. 1 and 2 of the drawings which shows a security enclosure 20 in the form of a cuboid-shaped box having upper and lower walls 22, 24, side walls 26, 28 and end walls 30, 32. The enclosure 20 comprises two flexible sheets or laminates which are formed as planar sheets and then folded to the desired form. FIG. 2 of the drawings shows the sheet which forms an outer wrapping for the enclosure 20, while FIG. 3 of the drawings illustrates the laminate 36 over which the sheet 34 is wrapped. The parts of the sheet and laminate 34, 36 which form the walls of the enclosure 22, 24, 26, 28, 30, 32 are identified by the reference numeral of the particular wall shown in parenthesis. The laminate 36 comprises various layers which are constructed to detect an attempt to penetrate the enclosure 20. Various electrical characteristics of the laminate 36 are monitored by means of a suitable electrical circuit, as will be described, and any attempt to penetrate the laminate or separate the sheet 34 from the laminate 36 results in a change in an electrical characteristic which is detected and used to activate an alarm, or destroy or erase information from the object contained within the enclosure 20.

In this particular example the object within the enclosure 20 is a keypad and the sheet 34 is marked with numerals and signs corresponding to the keypad configuration.

Figure 4:
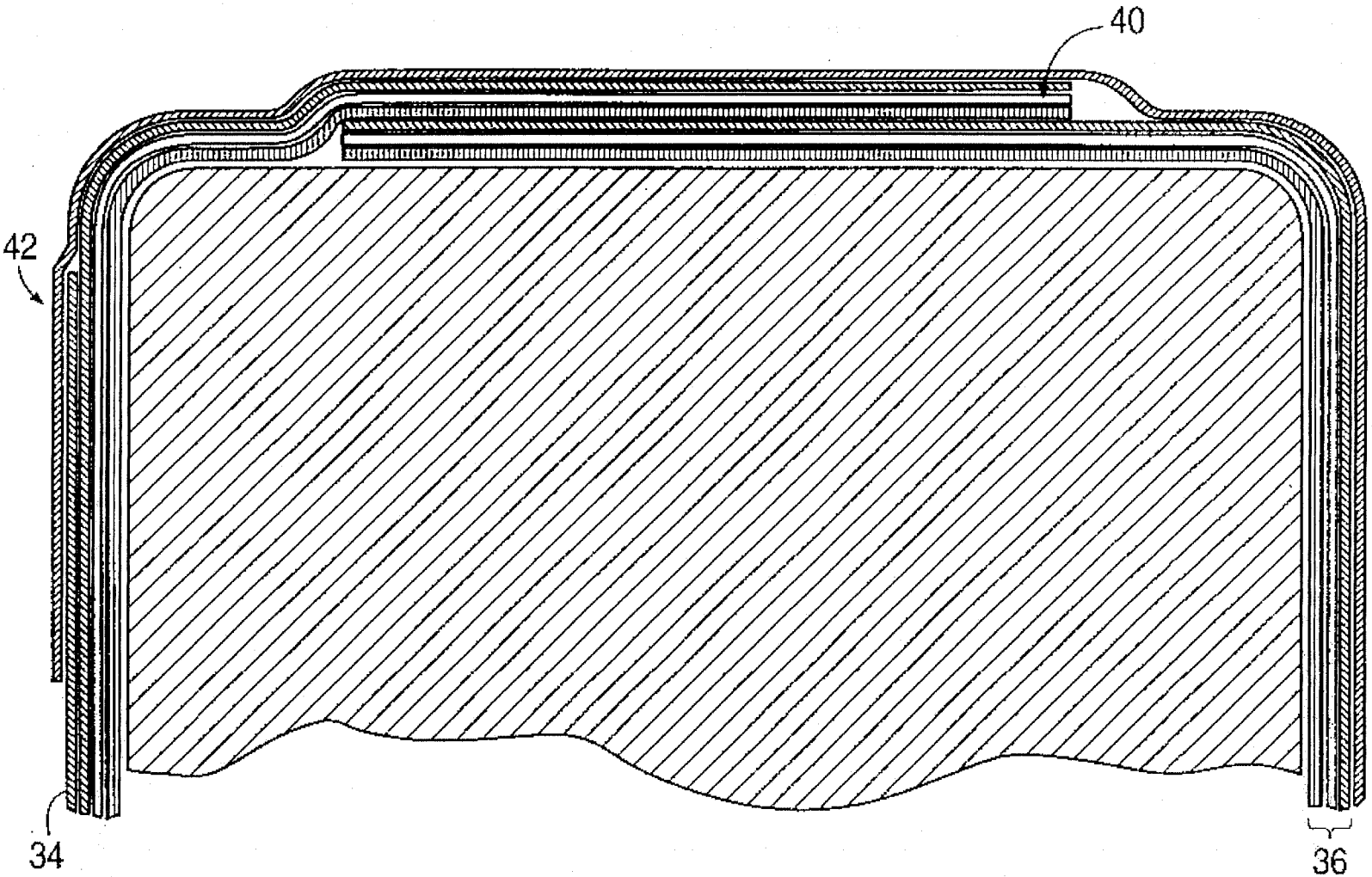
FIG. 4 is a sectional view of a portion of the enclosure of FIG. 1.

The enclosure 20 is formed by first folding the laminate 36 along various fold lines 38 to define a box-shaped inner enclosure. Adhesive is provided at the overlapping edges of the laminate to form secure overlaps 40, one of which is illustrated in FIG. 4 of the drawings. The adhesive coated sheet 34 is then wrapped over the adhesive coated inner enclosure formed by the laminate 36 and similarly arranged with edges in overlapping relation to encapsulate the inner enclosure. An overlap 42 formed at edges of the sheet 34 is also illustrated in FIG. 4.

Figure 5:
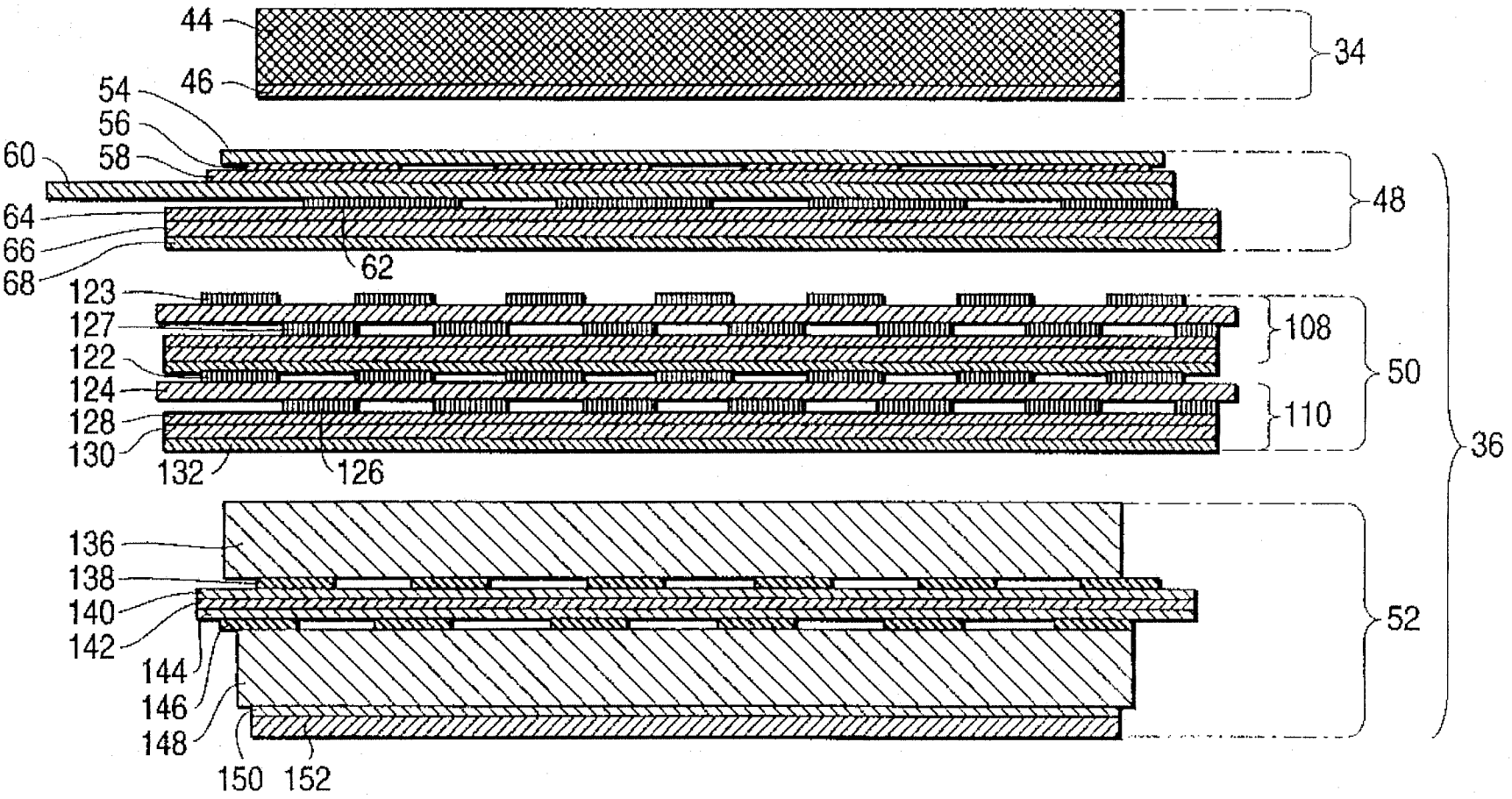
FIG. 5 is an enlarged sectional view of a wall of the enclosure of FIG. 1, showing various layers of the enclosure separated.

FIG. 5 of the drawings is an enlarged and somewhat schematic cross-sectional view of the sheet 34 and laminate 36 and illustrates the various layers which make up the sheet and laminate. The sheet 34 comprises an insulating sheet, in this example a polyester film 44, having a film of adhesive 46 on the inside face. The adhesive 46 is of pressure sensitive, heat reflowable adhesive, preferably a high vinyl acetate VA content ethylenevinyl acetate EVA, for example 70% of VA and also pigmented black.

The laminate 36 is considerably more complex and is shown separated into three layers which, for ease of reference, will be referred to as the tamper detect layer 48, the laser detect layer 50 and the pierce detect layer 52. It should be noted that, with regard to the present invention, it is the tamper detect layer 48 of the laminate 36 which is of primary importance. An enclosure within the scope of the invention may be formed without the laser detect layer 50 or the pierce detect layer 52, or with these layers 50, 52 replaced with layers of different configurations as described in the aforementioned patent applications.

The tamper detect layer 48 comprises an adhesive layer 54, lines or tracks of conductive material 56, a low tensile strength material 58 having lower cohesion than adhesion, an electrically insulating polyester film 60, further conductive tracks 62 and then a further insulating polyester film 66 sandwiched between two adhesive layers 64, 68 which serve to secure the tamper detect layer 48 to the laser detect layer 50.

The adhesive layers 54, 64, 68 are preferably of similar adhesive to the adhesive 46. The tracks 56, 62 are formed of semi-conductive ink, most preferably comprising a matrix of low molecular weight polyester resin filled with carbon and graphite. Typically each track 56, 62 may be formed with a resistivity of 6 ohms/cm for 25% carbon loading in polyester and is applied by screen printing to a dry thickness of approximately 10 microns.

The low tensile strength material 58 is somewhat similar to the adhesive used to form the layers 46, 54, 64, 68 and as such may comprise an ethylvinyl acetate (EVA) having a high vinyl acetate (VA) content, for example 70% VA, also filled to 45–60% (by weight EVA) with fumed silica (typically having particle size of 12 nm and 20 $m^2/g$ surface area). Like the adhesive layers, the material 50 preferably contains a black pigment such that the carbon-loaded tracks 56 are not easily visible on the material 58.

When the sheet 34 and laminate 36 are laminated together, preferably at a temperature within the range 60° to 80° C., the two layers of adhesive 46 and 54 become homogeneous after a time, typically one or two days.

The materials which form the adhesive layers and the low tensile strength material are selected to be chemically different from the conductive tracks such that only moderate carbon migration takes place from the tracks to the adjacent layers.

Figure 6:
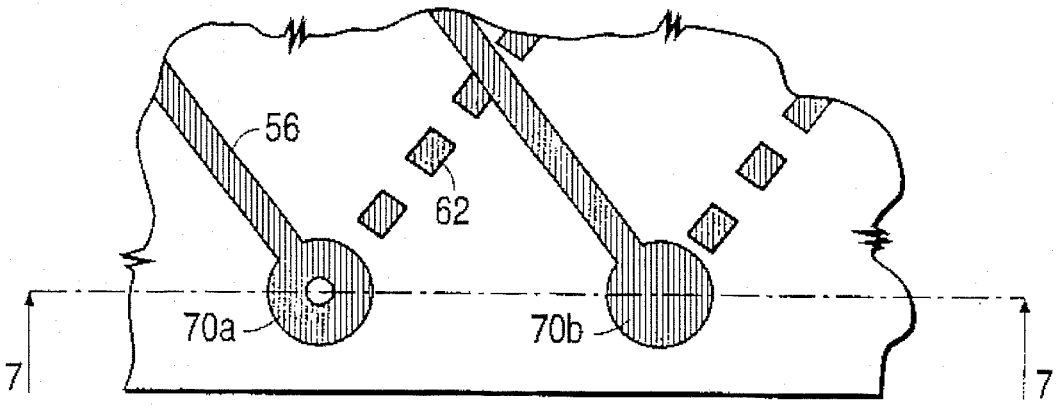
FIG. 6 is a plan view of an edge portion of one of the layers of the enclosure wall.
Figure 7:
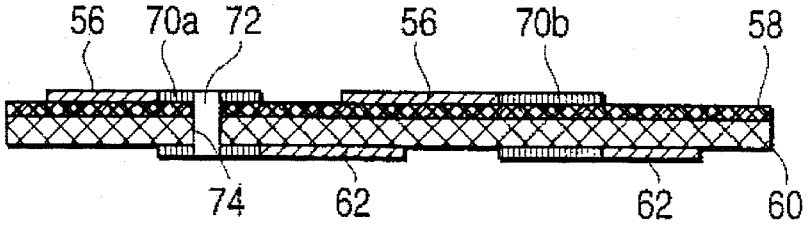
FIG. 7 is a sectional view on line 7—7 of FIG. 6.

The tracks 56, 62 extend diagonally across the film 60 and the tracks on one side extend obliquely relative to the tracks on the other side to divide the film into a matrix 65 (FIG. 8) of diamond shaped areas. Each track 56, 62 terminates at an edge portion of the film 60, in a point or pad 70 (FIG. 6), the pad on each side being in register with a pad on the other side of the film. Two pairs of registering pads 70*a*, 70*b* may be seen in FIGS. 6 and 7 of the drawings. A connection between the tracks is provided at the pads 70*a* by forming a hole 72 through the layer 58 and film 60 such that when the tracks 56, 62 are formed, preferably by printing, the semi-conductive ink used to form the tracks on one side extends through the hole 72 into contact with the tracks on the other side. In practice, the tracks are printed on one side of the film before the holes are formed. The holes are then punched in the film and the connecting hole lining 74 is formed when the second set of tracks are printed on the other side of the film. The matrix of tracks 56, 62 are so connected to form a number of loops or conductors, which will be broken if an attempt is made to penetrate the film. It will be seen that the pads 70*b* are devoid of a through hole such that there is no interconnection between lines at the pad 70*b*.

Figure 8:
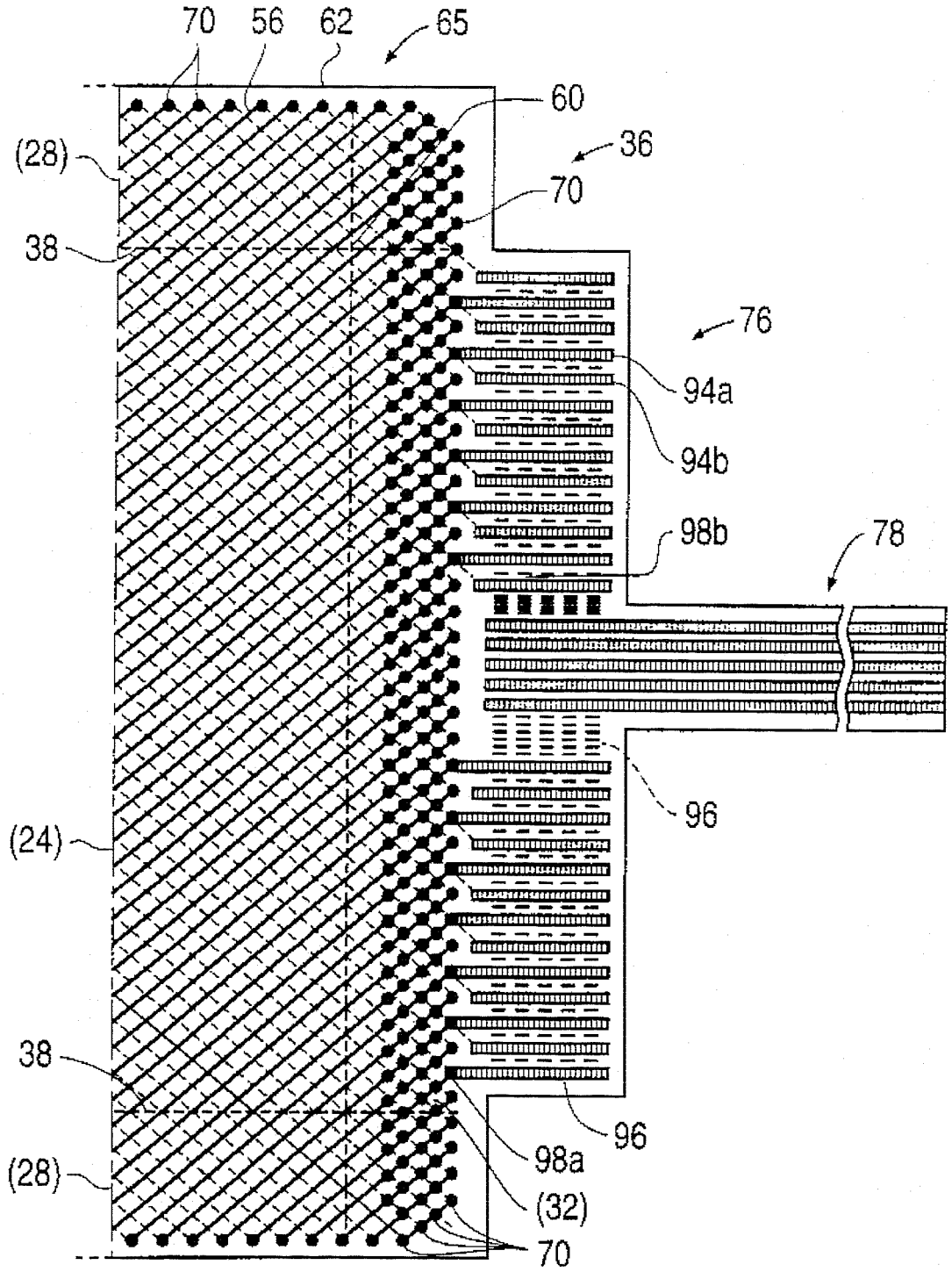
FIG. 8 is an enlarged plan view of an edge portion of the layer of FIG. 3.

In this particular embodiment of the present invention the tracks 56, 62 are configured to define four conductors or loops. As will be described, the configuration of tracks which form the conducting loops may be varied such that examination of one security enclosure would not reveal the loop configuration of another similar security enclosure. Also, the connections between the loops and the detection circuit may be varied for different enclosures thus increasing the difficulty in gaining unauthorised entry to the enclosure. FIG. 8 of the drawings illustrates one end of the laminate 36 where the end of each track 56, 62 is provided with five pads. Further, the connection between the tracks and the detection circuit (FIG. 9) is through connecting means in the form of a matrix of conducting paths 76 which are connected to connectors 78 for linking with the detection circuit.

Figure 9:
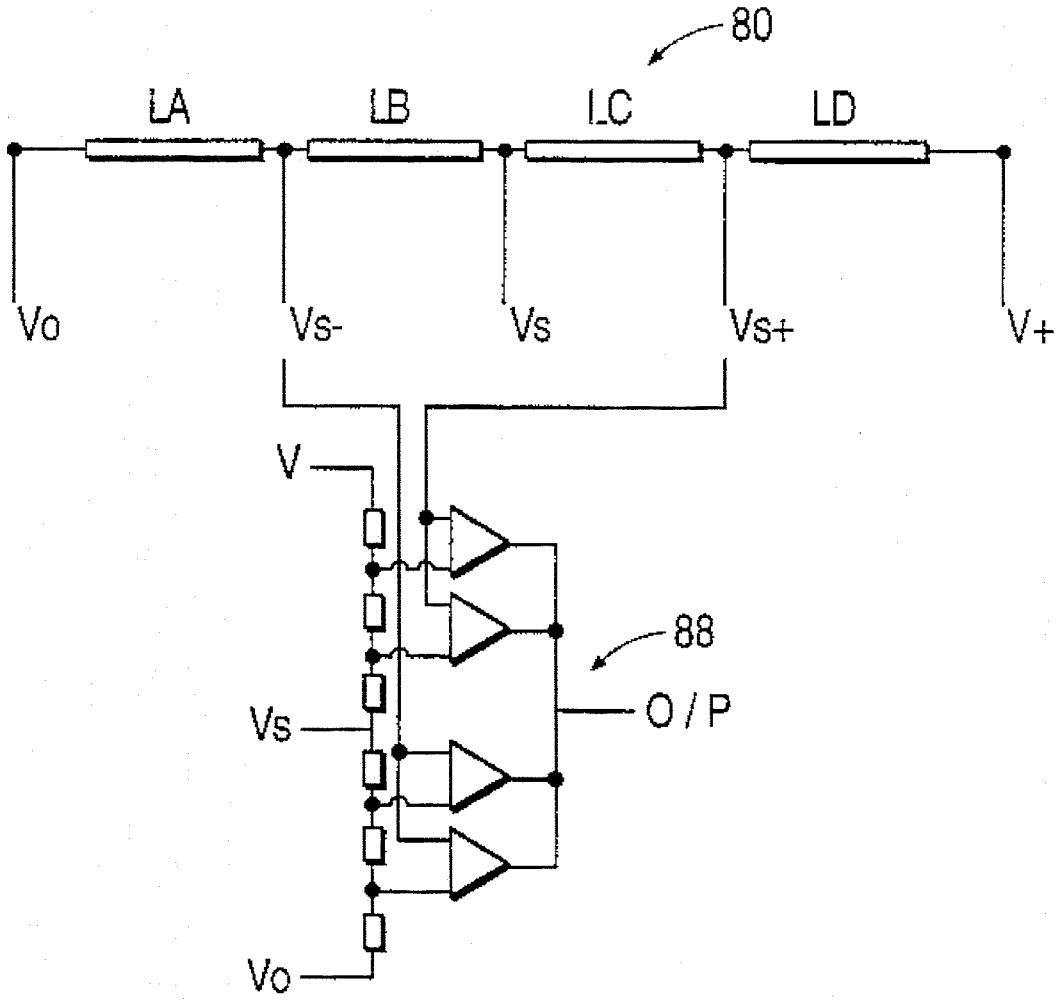
FIG. 9 is a schematic representation of a detection circuit of the enclosure of FIG. 1.

FIG. 9 of the drawings illustrates the circuit 80 which detects changes in the electrical characteristics of the laminate 36. The blocks LA, LB, LC, LD represent the four loops formed by the tracks 56, 62 printed on the film 60. In this particular example the loops are connected in series between reference potentials Vo, Vs and V+. Connections are made between each loop and a comparator circuit 88 which is set to detect any change in the monitored potentials Vs–, Vs+, in this particular example, the end of the first loop LA and the beginning of the second loop LB and at the end of the third loops LC and the beginning of the fourth loop LD. Any damage to the loops LA, LB, LC, LD will result in a change in the monitored potentials Vs–, Vs+, creating an output from the comparator circuit 88 which may be passed to a suitable amplifier, to activate an alarm or some other appropriate action.

Referring once more to FIG. 8, the conducting paths 76 comprise, with reference to this particular illustration, a series of longitudinal paths 94 on the upper surface of the film 60 and a series of lateral paths 96 on the underside of the film. The lateral paths 96 pass beneath the connectors 78 and electrical connection between selected ones of the connectors 78 and the lateral conducting paths 96 are made in the same manner as the connections at the pads, that is by forming a hole through the film at the intersection of the paths 96 and connectors 78 and printing one of the tracks such that the conducting ink extends through the hole to form a connection between the tracks. Connections between the lateral paths 96 and the longitudinal paths 94 are achieved by the same means.

The longitudinal conductive paths 94 alternate between longer paths 94*a* which extend to contact the pads 98*a* at the extreme edge of the matrix 65 formed by the tracks 56 and shorter paths 94*b* which terminate at end pads 98*b* directly above pads provided at the ends of alternative conductive tracks 62 on the underside of the film 60.

It will be noted that there are a great number of possible connections which may be made between the paths 94, 96 and the matrix 65. This facility allows the manufacturer to vary the connections between the matrix 65 and the paths 94, 96 and thus the connections between the matrix 65 and the connectors 78. Thus, if reference is also made to FIG. 9, each of the loops LA, LB, LC, LD could be represented by any one of many configurations of tracks 56, 62 on the sheet and thus it would be extremely difficult for an intruder to predict the path of a particular loop, and its particular reference potentials, from an examination of even a large number of enclosures provided with similar laminates.

To allow use of a similar comparator circuit 88 for each sheet produced it is necessary that the total length of each loop, however formed on the film 60, be of similar length such that the resistance or change in potential across each loop is the same and the loops may therefore be "located" in any desired position relative to the comparator circuit 88.

The configuration of the laminate as illustrated in FIG. 8 further provides for the configuration of loops to be varied as each track 56 on one side of the film 60 may be connected to one of five tracks 62 on the other side of the film 60 by providing line switch means in the form of a line connection through the film 60 between the line 56, 62 by any one of five pads provided at the edge of the matrix 65. When combined with the matrix of connecting paths this feature allows many permutations of loops to be provided, each loop being at one of four different reference potentials.

Reference is once more made to FIG. 5 and particular reference is made to the low tensile strength layer over which the conductive tracks 56 are printed. An attempt to remove the sheet 34 from the inner enclosure by peeling back the sheet 34 would thus result in breakup of the low tensile strength layer 58 and damage to the tracks which damage would be detected by the detection circuit. The laminate 36 is arranged such that the tracks 56 and low tensile strength layer 58 extend over the whole surface of the inner enclosure and an attempt to separate the sheet 34 at the laminate 36 at any location on the enclosure is likely to damage the tracks 56. While this arrangement is straightforward to create at the majority of overlapping edge portions, such as the overlap 40 illustrated in FIG. 4, the formation of the corners between perpendicular wall portions of the laminate 36 is not so straightforward, as will be described.

Figure 3:
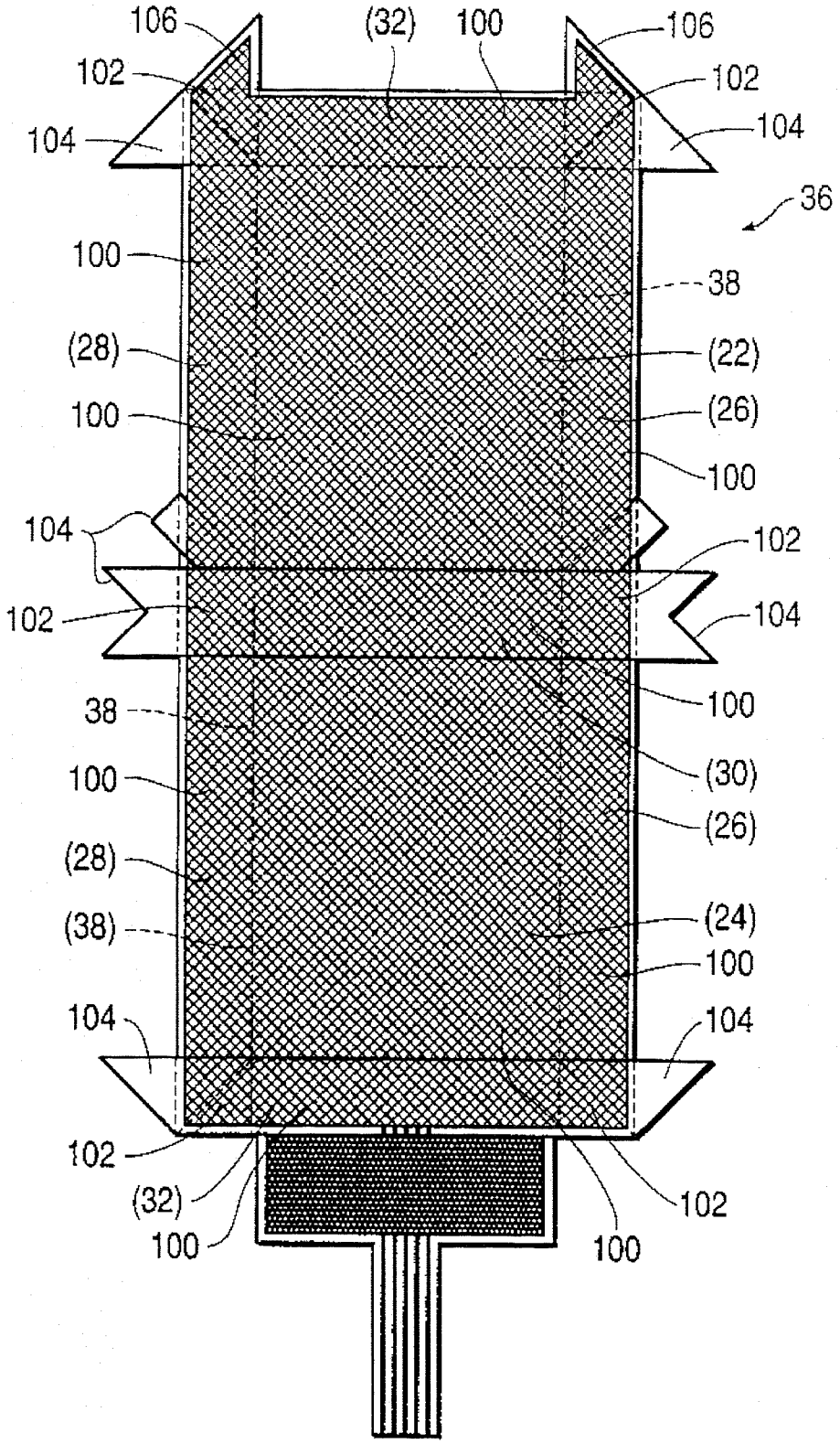
FIG. 3 is a plan view of an inner protection layer of the enclosure of FIG. 1.

If reference is made to FIG. 3 of the drawings, nine major wall carrying portions 100 are provided and defined by the fold lines 38. These wall forming portions 100 carry the conductive tracks 56, 62 and in the enclosure 20 will form parts of the enclosure walls. Between the major wall forming portions 100, and also carrying the conductive tracks 56, 62, are a number of intermediate wall forming portions 102 which are folded in on themselves to permit the adjacent major wall forming portions 100 to be folded into positions where the portions 100 lie perpendicular to one another. To ensure that no shorting occurs between the tracks 56 on parts of each intermediate wall forming portion 102, a wing 104 of insulating film is provided adjacent each portion 102 which may be folded and located between the parts of the portion 102 to provide a conductive track to insulating material interface. In this example the wings 104 are either triangular or chevron-shaped. Similarly, at two locations the flaps formed by folding the intermediate wall forming portions 102 will be folded and adhered to an adjacent portion of the inner enclosure. This would normally result in an insulating material to insulating material interface and to avoid this second triangular wings 106, which carry conductive tracks 56, are provided to allow the formation of conductive track to insulating material interfaces. With the particular laminate configuration as illustrated in FIG. 3 only two secondary wings 106 are necessary, the remainder of the area which carries conductive tracks 56, 62 being rectangular. This considerably simplifies the manufacture of the laminate.

The first wings 104 are simply extensions of the film 60 while the second wings 106 may consist of extensions of the film 60 and tracks 56 or may include the complete three layers 48, 50, 52.

Reference is now made once more to FIG. 5 of the drawings to describe the laser detect and pierce detect layers 50, 52. The laser detect layer 50 is formed of two similar parts 108, 110 and the inner part 110 will be described as exemplary of both. The part 110 includes a plurality of conductive tracks 122, 126 printed on either side of an insulating film 124. The film 124 is mounted on a further insulating film 130 and secured thereto by an adhesive layer 128. A further adhesive layer 132 is provided for securing the layer 50 to the layer 52. The tracks 122, 126 on each side of the film 124 extend in parallel and are of a width and pitch, for example 250 microns wide with a pitch of 500 microns such that piercing of the part 110 at any point would result in damage to at least one of the sets of tracks 122, 126. The tracks 122, 126 each define conductors and are connected to the detection circuit 80. The upper part 108 is essentially identical to the inner part 110 though is arranged such that the tracks 123, 127 extend perpendicular to the tracks 122, 126 (although not being shown in this manner in FIG. 5) to ensure complete coverage by one or more of the tracks 122, 126, 123, 127.

The pierce detect layer 52 is as described in GB 2256958A in that it comprises two layers of fibrous semi-conductive material 136, 148 adhered by adhesive 138, 146 to an insulating film 142. In addition, layers of semi-conductive low melt material 140, 144 are provided between the fibrous layers 136, 148 and the insulating film 142. The lengths of the fibres of the fibrous material are greater than the thickness of the layer of insulating film 142 so that piercing the enclosure forces fibres from one fibrous layer 136 to penetrate the insulating film 142 and contact the other fibrous layer 148 to produce a detectable change in an electrical characteristic of the layers 136, 148, which are connected to the detection circuit 80.

Further, if a laser or other elevated temperature cutting means penetrates the layers the low melt material 140, 144 will melt and flow through any breaks in the insulating film 142 to form a detectable electrical connection between the semi-conductive fibrous layers 136, 148.

A further layer of insulating film 152 is fixed to the inner fibrous layer 148 using adhesive 150.

In practice, the layers 48, 50, 52 will be manufactured individually and then bonded together to produce the laminate 36. The laminate is then folded about the fold lines 38 to create the inner enclosure. The sheet 34 is then wrapped over the inner enclosure. If reference is made in particular to FIG. 4 of the drawings, it will be noted that the overlaps 40, 42 of the edges of the laminate and sheet 36, 34 are at spaced locations on the enclosure walls. With this arrangement an intruder wishing to gain access to the laminate overlap 40 must first peel back the sheet 34 over a considerable area of the laminate before reaching the edge of the overlap 40. Further, it will be noted that the overlaps 40, 42 are of different hand which further increases the degree of separation necessary to reach the edge of the inner overlap 40.

It will also be noted that separation of the edges of the laminate 36 at the overlap 40 requires the insulating film 152 to be separated from the outer surface of the tamper detect layer 48 which carries the conductive tracks 56, such that in the attempt of separation would result in damage to the tracks 56.

Figure 10:
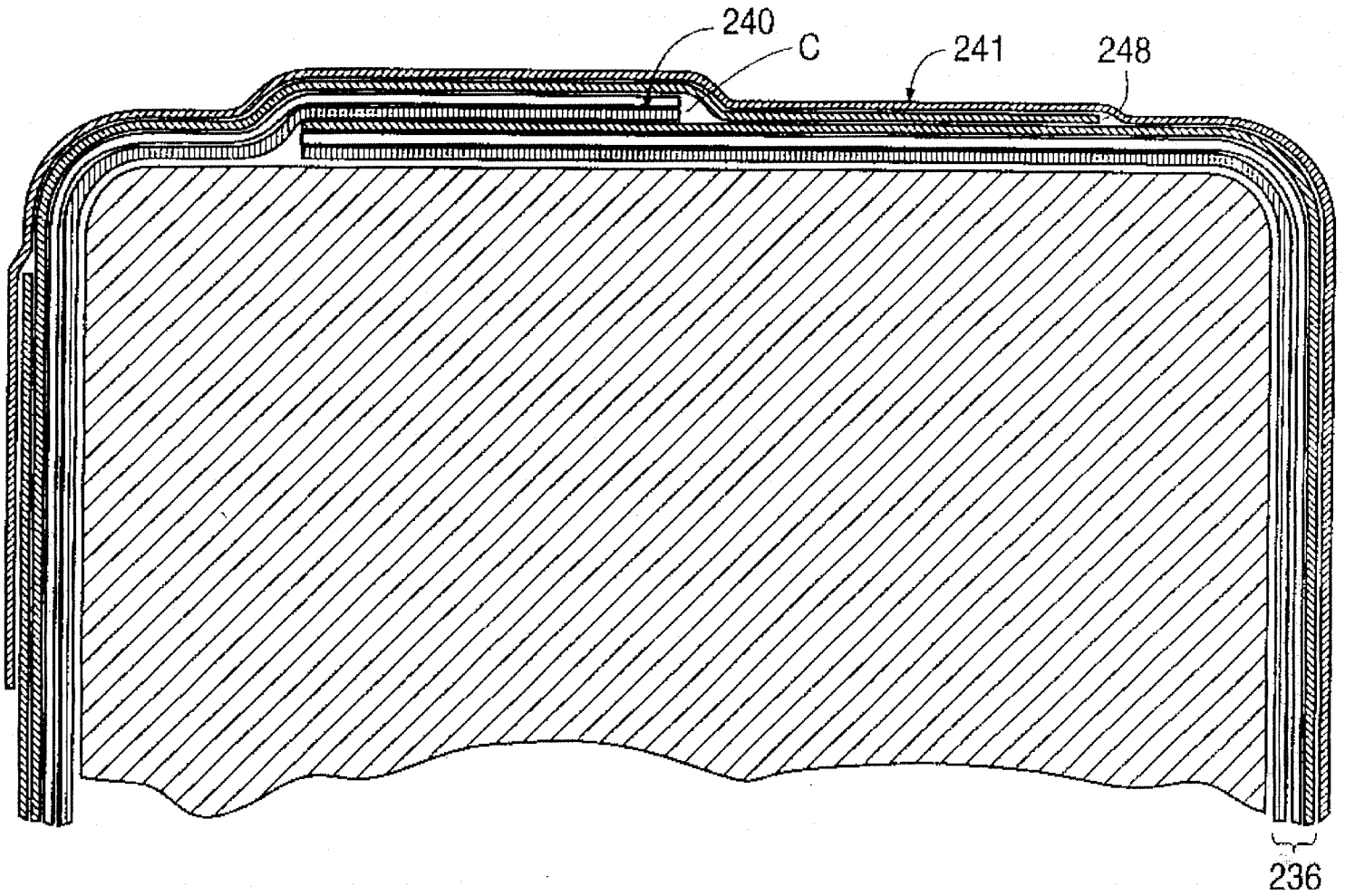
FIG. 10 is a sectional view of a wall of a security enclosure in accordance with another embodiment of the present invention.

Reference is now made to FIG. 10 of the drawings which illustrates a further embodiment of the present invention in which the overlap 240 of a laminate 236, similar to the laminate 36 described above, has been rendered more secure by extending the tamper detect layer 248 to form an overlap portion 241 and to provide an additional protective layer to further protect the exposed edge of the laminate 236, which an intruder might otherwise be able to gain access to by cutting through the sheet 234 at the point marked C.

From the above description it will be clear to those of skill in the art that the method of producing a security enclosure described above, and the security enclosure which is produced by the method, offer improved protection against unauthorised entry to the enclosure. It will also be clear to those of skill in the art that various modifications and improvements may be made to the described embodiments without departing from the scope of the invention.

I claim:

1. A method of forming a security enclosure (20) comprising the steps:

providing a first electrically insulating sheet (60) carrying a layer (56) of electrically responsive material on one side;

providing detection means (80) for detecting separation of the electrically responsive material from the sheet (60);

connecting said detection means (80) to the layer (56);

folding said first electrically insulating sheet (60) to define an inner enclosure with said electrically responsive layer (56) extending over an external surface thereof and said detection means (80) located therewithin;

providing a second electrically insulating sheet (44);

providing adhesive material (46, 54) on at least one of said external surface and said second electrically insulating sheet (44); and wrapping said second electrically insulating sheet (44) about said inner enclosure to encapsulate said inner enclosure.

2. The method of claim 1 wherein a low tensile strength material (58) having lower cohesion than adhesion is located between the first electrically insulating sheet (60) and the electrically responsive material (56).

3. The method of claim 1 wherein the electrically responsive material is provided in the form of one or more lines (56).

4. The method of claim 3 wherein adhesive material is provided at selected edge portions (100) of said first electrically insulating sheet (60) and on folding said first electrically insulating sheet (60) to define the inner enclosure said selected edge portions are placed in overlapping relation.

5. The method of claim 4 for use in forming a box-like security enclosure (20) and comprising the further steps of:

providing the first electrically insulating sheet (60) with major wall forming portions (100) carrying said electrically responsive lines and intermediate wall forming portions (102) located between the major wall forming portions;

folding said intermediate wall forming portions (102) to permit said major wall forming portions (100) to define corners of a box-like enclosure including folding selected intermediate wall forming portions (102) to produce electrically responsive line to electrically responsive line interfaces;

providing first wings (104) of electrically insulating sheet extending beyond an area of said first electrically insulating sheet (60) carrying said electrically responsive line (56); and locating said first wings (104) between said folded selected intermediate wall forming portions (102) to provide electrically responsive line to electrically insulating material interfaces therebetween.

6. The method of claim 5 comprising the further steps of:

folding further selected intermediate wall portions (102) to produce electrically insulating material to electrically insulating material interfaces;

providing second wings (106) of electrically insulating sheet carrying portions of said electrically responsive line; and locating said second wings (106) between said folded further selected intermediate wall portions (102) to provide electrically responsive line to electrically insulating material interfaces therebetween.

7. The method of claim 5 in which said electrically responsive material (56) is provided over a substantially rectangular area of said first electrically insulating sheet (60).

8. The method of claim 4 wherein said second electrically insulating sheet (44) is wrapped about said inner enclosure with edge portions of said second electrically insulating sheet in overlapping relation.

9. The method of claim 8 in which the overlapping edge portions of said second electrically insulating sheet (44) are formed on the inner enclosure spaced from the overlapping edge portions of said first electrically insulating sheet (60).

10. The method of claim 8 in which the overlapping edge portions of said first electrically insulating sheet (60) and the overlapping edge portions of said second electrically insulating sheet (44) are formed of opposite hand.

11. The method of claim 1 further comprising;

providing said first electrically insulating sheet (60) with lines of electrically responsive material (56, 62) on each side, the lines (56) on one side extending obliquely relative to the lines (62) on the other side and the lines (56, 62) being interconnected at edge portions of the sheet (60) to form a plurality of conductors (LA, LB, LC, LD) so dividing the sheet into a number of relatively small areas that attempted penetration of the sheet (60) damages the lines (56, 62), one edge portion of the sheet including a plurality of first switch means;

selectively configuring the switch means to connect each one of the lines (56) on one side of the sheet with a selected one of a plurality of lines (62) on the other side of the sheet; and connecting ends of the conductors (LA, LB, LC, LD) to the detecting means (80) for detecting damage to the lines.

12. A security enclosure (20) comprising:

an inner enclosure defined by a first electrically insulating sheet (60) carrying a layer (56) of electrically responsive material on an outer side, the sheet (60) being folded and having edges (100)in overlapping relation and adhered to one another to define the inner enclosure;

detecting means (80) for detecting separation of the electrically responsive material (56) from the sheet (60) and said means being located inside said inner enclosure; and an outer enclosure defined by a second electrically insulating sheet (44) wrapped about and adhered to said inner enclosure and having edges in overlapping relation.

13. The security enclosure of claim 12, in which a low tensile strength material (58) having lower cohesion than adhesion is located between the first electrically insulating sheet (60) and the electrically responsive layer (56).

14. The security enclosure of claim 12 in which the electrically responsive material is provided in the form of one or more lines (56).

15. The security enclosure of claim 12, in which the overlapping edges of said second insulating sheet (44) are spaced from the overlapping edges of said first electrically insulating sheet (60).

16. The security enclosure of claim 12, in which the overlapping edges of said first electrically insulating sheet (60) and the overlapping edges of said second insulating sheet (44) are of opposite hand.

17. The security enclosure of claim 12, in which the first electrically insulating sheet forms part of an outer detection layer (248) of the inner enclosure and the inner enclosure further includes an inner detection layer the inner detection layer extending beyond at least one edge of the inner detection layer to provide at least one overlapping edge of the inner enclosure with a first portion (240) in which edges of both detection layers overlie the other edges of the layers and a second portion (241) in which only the outer detection layer overlies the other edges of the layers.

18. The security enclosure of claim 12 in which lines of electrically responsive material (56, 62) are provided on each side of said first electrically insulating sheet (60), the lines (56) on one side extending obliquely relative to the lines (62) on the other side and the lines being interconnected at edge portions (60) of the sheet to form a plurality of conductors (LA, LB, LC, LD) so dividing the sheet into a number of relatively small areas that attempted opening of the enclosure damages the lines (56, 62), one edge portion of the sheet including a plurality of first switch means which are selectively configured to connect each one of the lines (56) on one side of the sheet (60) with a selected one of a plurality of lines (62) on the other side of the sheet (60), and further including connecting means (76) for connecting ends of the conductors to the detecting means (80) for detecting damage to the lines.

19. The security enclosure of claim 18 wherein the lines (56) on one side of the sheet (60) are connected to the lines (62) on the other side of the sheet (80) at spaced points (70) along the edges of the sheet (60), the points on one side of the sheet being in register with the points on the other side of the sheet.

20. The security enclosure of claim 19 wherein at the edge portion of the sheet provided with first switch means, each line (56) on one side of the sheet overlies a plurality of lines (62) on the other side of the sheet, a point (70) being provided on each side of the sheet at the location of each overlap, but only one point (70*a*) on each line (56, 62) providing a connection.

21. The security enclosure of claim 19 wherein the lines (56, 62) on opposite sides of the sheet are interconnected at each pair of connected registering points (70*a*) by a semi-conductive or conductive material (74) extending through a hole (72) formed in the sheet (60) at the registering points (70).

22. The security enclosure of claim 12 in which: lines (56, 62) of electrically responsive material are provided on each side of said first electrically insulating sheet (60), the lines (56) on one side of the sheet extending obliquely relative to the lines (62) on the other side and being connected thereto at edge portions of the sheet to form a plurality of conductors (LA, LB, LC, LD), so dividing the sheet into a number of relatively small areas that attempted opening of the enclosure damages one or more of the lines (56, 62).

23. The security enclosure of claim 12 in which the first electrically insulating sheet (60) forms part of an outer detection layer (48) of the inner enclosure and the inner enclosure includes a further inner detection layer (110), said inner detection layer (110) comprising a third electrically insulating sheet (124) carrying lines (122, 126) of electrically responsive material on each side, the lines (122, 126) being arranged in parallel and having a width and pitch such that the lines (122, 126) collectively provide electrically responsive material on said third electrically insulating sheet (124) on at least one side over the whole extent thereof, penetration of the enclosure damaging at least one of the lines (122, 126) and which damage is detectable by said detecting means (80).

24. The security enclosure of claim 23, further comprising a still further inner detection layer (108) similar to said further inner detection layer (110) and adhered thereto with the lines (123, 127) of said still further inner detection layer (108) extending perpendicular to the lines (122, 126) of said further inner detection layer (110).

* * * * *